United States Patent [19]

Oberst

[11] 4,014,124

[45] Mar. 29, 1977

[54] SAFETY MARKER FOR FIREARM

[75] Inventor: E. Ernest Oberst, Cheshire, Conn.

[73] Assignee: The Marlin Firearms Company, North Haven, Conn.

[22] Filed: June 10, 1976

[21] Appl. No.: 694,590

[52] U.S. Cl. ..... 42/1 Y

[51] Int. Cl.[2] ..... F41C 27/10

[58] Field of Search ..... 42/1 Y

[56] References Cited

UNITED STATES PATENTS

| | | | |
|---|---|---|---|
| 2,590,516 | 3/1952 | DeVonBreymann | 42/1 Y |
| 3,022,596 | 2/1962 | Cannon | 42/1 Y |
| 3,713,239 | 1/1973 | Sperling | 42/1 Y |

*Primary Examiner*—Charles T. Jordan
*Attorney, Agent, or Firm*—Walter Spruegel

[57] ABSTRACT

A safety marker is attachable to a trigger guard on a firearm in apparent interference with accustomed manipulation of the trigger, with the marker resembling a shield which presents an abnormal and startling sight on the firearm, and by its apparent interference with trigger manipulation has the effect of discouraging unauthorized handling of the firearm.

2 Claims, 4 Drawing Figures

SAFETY MARKER FOR FIREARM

This invention relates to safety devices for firearms.

It is a primary object of the present invention to provide a safety adapted for attachment to a firearm in order to discourage unauthorized and potentially hazardous handling of the firearm when the same is not in use. To this end, the safety is provided, quite contrary to conventional firearm safeties with their action-disabling function, in the form of a non-disabling safety which is designed not only to present an abnormal and startling sight on the firearm, but also to leave any observer with the clear and unmistakable impression that the marker signifies handling of the firearm as being particularly hazardous for some reason. Thus, the marker is particularly effective in discouraging unauthorized handling of the firearm while the marker is attached thereto.

It is another object of the present invention to provide for a firearm the aforementioned safety marker in a form resembling a shield, and provide for its attachment to the firearm in a manner in which the same interferes with free finger access to the trigger and, hence, with pulling of the trigger for firing the arm. Thus, the marker in its shield-resembling form does indeed present a startling and unaccustomed sight on the firearm, and its appearance in close proximity to and deliberate interfering relation with the trigger serves as a particularly forceful warning to keep hands off the trigger.

It is a further object of the present invention to provide the safety marker in the aforementioned shield-resembling form which lends itself to finish-formation at exceedingly low cost by simple blanking from sheet stock, preferably inexpensive plastic, and which is attachable to and releasable from a firearm by quick and simple snap-on and snap-off.

It is another object of the present invention to form the shield-resembling safety marker as a substantially flat and resiliently flexible element having an elongated body part of an outline similar to that of human lips, and a rest part, of which the body part defines a center field and opposite arms continuous with and extending outwardly from the center field, and the rest part is continuous with and depends from the center field, with distortion of the body part in resilient U-flexure being relied on for snap attachment of the marker to a trigger guard by holding the body part so distorted to permit its extension into the trigger guard and then simply releasing the body part for its partial recovery and ensuing resilient lock to the trigger guard for its retention therein.

Further objects and advantages will appear to those skilled in the art from the following, considered in conjunction with the accompanying drawings.

In the accompanying drawings.

Figure 1:
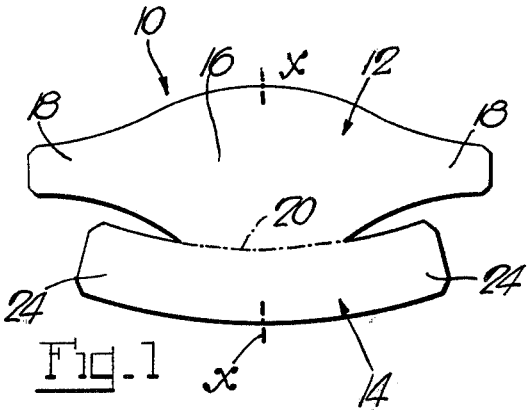
FIG. 1 is a front view of a safety marker embodying the invention.
Figure 2:
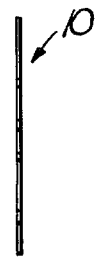
FIG. 2 is a side view of the safety marker.

Referring to the drawings, and more particularly to FIG. 1 thereof, the reference numeral 10 designates a safety marker which is adapted for attachment to a firearm for the purpose of discouraging unauthorized handling of the latter while not in use. The marker 10 is of any suitable sheet material, preferably inexpensive plastic, which is resiliently flexible for its temporary distortion while in use. The marker is shaped to resemble a shield to present as such a fully intended unaccustomed and startling sight on a firearm (FIG. 3), with the marker being to this end formed in two distinct complemental parts, i.e., an elongated body part 12 and a stop or rest part 14. The body part is in this instance of an outline which more or less resembles the outline of human lips (FIG. 1), with this body part being formed to provide a center field 16 and opposite, outwardly tapering arms 18 which are continuous with and project from the opposite sides of the center field 16. The rest part 14 is continuous with the body part 12 and formed as a skirt depending from the bottom of the center field which is depicted by the dot-and-dash line 20. For its neat appearance, the marker 10 is formed symmetrical with respect to a center axis *X*. The skirt-like rest part 14 is preferably provided with opposite prong extensions 24 which extend beyond the bottom 20 of the center field 16. The marker 10, and especially the center field 16 or the rest part 14 or both, may carry any message suitable to discourage handling of the firearm to which the marker is attached. The marker is preferably substantially flat (FIG. 2) when not attached to a firearm, and is advantageously finish-formed by simple blanking from suitable sheet stock.

Figure 3:
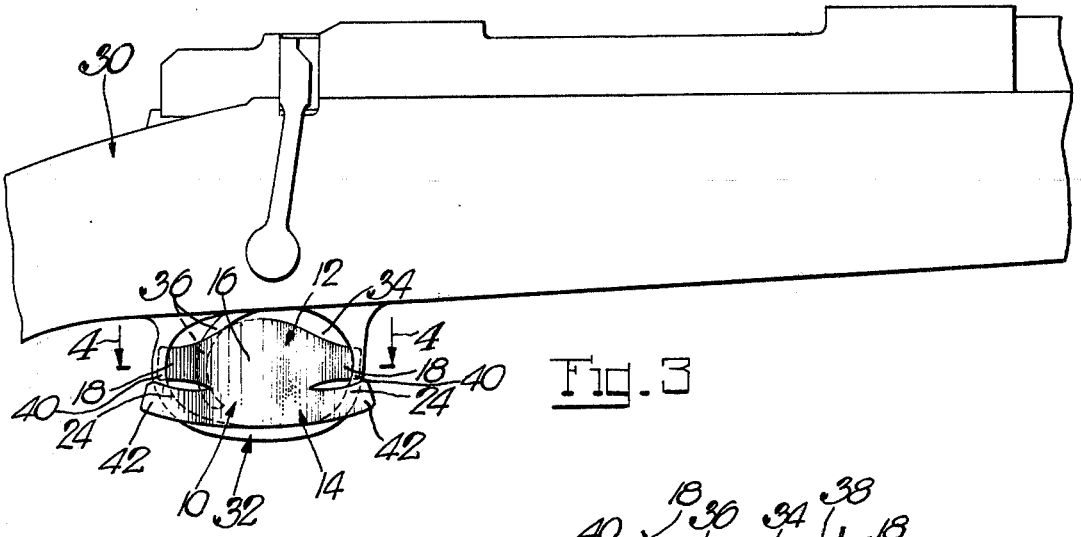
FIG. 3 is a front view of the safety marker as applied to a firearm.
Figure 4:
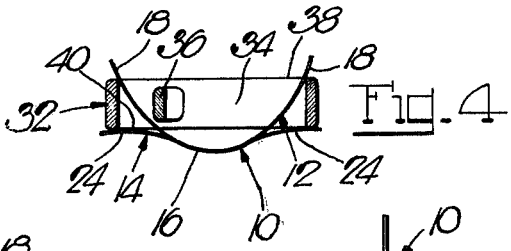
FIG. 4 is a section taken substantially on the line 4—4 of FIG. 3.

The marker 10 is applied to a firearm 30 advantageously in quick snap-on fashion, and significantly to the trigger guard 32 of the firearm (FIG. 3). Thus, for its attachment to the trigger guard 32 of the firearm 30 by an attendant, the marker 10 is grasped at the opposite arms 18 of the body part 12 between an index finger and thumb, for example, of one of the attendant's hands and then contracted so as to flex the body part 12 into substantial U-shape and thereby shorten it sufficiently to lead it with its arms 18 into the opening 34 in the trigger guard, with the arms 18 being on opposite sides of the trigger 36 (FIGS. 3 and 4). The flexed body part 12 is thus extended by the attendant into the opening 34 in the trigger guard until the rest part 14, including its end prongs 24, come to bear against the trigger guard 32 (FIGS. 3 and 4), whereupon the attendant releases the finger grip on the flexed body part and thereby permits the latter to snap back toward its non-flexed condition but only far enough to back the arms 18 against the trigger guard 32 on the side 38 thereof opposite the side 40 against which the prong ends 24 of the rest part 14 bear (FIG. 4). The end prongs 24 and the arms 18 thus straddle the trigger guard 32 on opposite sides thereof and thereby retain the marker 10 securely attached to the trigger guard until removed therefrom, with the marker being easily removed from the trigger guard in snap-off fashion by pulling either prong end 24 at 42 (FIG. 3) away from the adjacent side of the trigger guard. In attaching the marker 10 to the trigger guard 32 as described, the rest part 14 with its prong ends 24 will rest on the adjacent front side 40 of the trigger guard while the flexed body part 12 is still spaced from the trigger 36 so that the latter remains untouched in applying the marker.

The applied marker 10 presents a totally unaccustomed and truly startling sight (FIG. 3) which certainly will draw particular attention to the firearm and thereby impress any observer with the arrangement of the applied marker in unmistakable interference with the trigger 36. This most impressive demonstration by the applied marker of disabling the trigger of the firearm unmistakably conveys the intended purpose of the marker strongly to discourage unauthorized handling of the firearm particularly at the trigger.

What is claimed is:

1. A safety marker for a firearm with a trigger and a trigger guard, comprising a substantially flat and resiliently flexible shield having an elongated body part of an outline similar to that of human lips, and a rest part, of which said body part defines a center field with opposite sides and a bottom between said sides, and opposite arms continuous with and extending outwardly from said sides of the center field, and said rest part is continuous with said center field and depends from said bottom thereof, with said body part being of sufficient length to permit its distortion in resilient U-flexure for its extension into and retention in a trigger guard with its arms on opposite sides of the trigger therein.

2. A safety marker for a firearm with a trigger guard and a trigger as in claim 1, in which said rest part has opposite sides in line with said sides of said center field, and there are further provided opposite prongs continuous with and extending outwardly from said sides of said rest part, with said arms and prongs being urged by resilient distortion of said body part against the opposite sides of a trigger guard in which said body part is retained.

* * * * *